United States Patent [19]

Honnorat et al.

[11] 3,966,374

[45] June 29, 1976

[54] APPARATUS FOR THE MANUFACTURE OF SPHERICAL METALLIC POWDER NON-CONTAMINATED BY AMBIENT ATMOSPHERE

[75] Inventors: Yves C. Honnorat, Imphy; Gerard D. Raisson; Jean G. Morlet, both of Nevers, all of France

[73] Assignee: Creusot-Loire, Paris, France

[22] Filed: Dec. 11, 1974

[21] Appl. No.: 531,812

[30] Foreign Application Priority Data

Dec. 20, 1973 France ..... 73.45788

[52] U.S. Cl. ..... 425/7; 264/12; 266/217

[51] Int. Cl.[2] ..... B28B 1/54

[58] Field of Search ..... 425/7; 264/12; 75/59, 75/60; 266/34 R, 35

[56] References Cited

UNITED STATES PATENTS

| | | | |
|---|---|---|---|
| 3,334,408 | 8/1967 | Ayers | 425/7 X |
| 3,695,795 | 10/1972 | Jossick | 425/7 |
| 3,752,611 | 8/1973 | Reed et al. | 425/7 |
| 3,771,929 | 11/1973 | Hellman et al. | 425/7 |

*Primary Examiner*—Richard B. Lazarus

*Attorney, Agent, or Firm*—Cameron, Kerkam, Sutton, Stowell & Stowell

[57] ABSTRACT

In the production of metallic powder by atomization, using jets of inert gas, of a stream of molten metal entering a receiver, the atomized stream of molten metal is subject to the action of vortices produced within the receiver by a tangential flow of inert gas in the lower part of the receiver in order to increase the number of impacts between the atomized metal and the receiver walls to increase the rate of cooling of the atomized metal.

3 Claims, 4 Drawing Figures

APPARATUS FOR THE MANUFACTURE OF SPHERICAL METALLIC POWDER NON-CONTAMINATED BY AMBIENT ATMOSPHERE

The present invention refers to the manufacture of metallic powder by gaseous atomization of a jet of liquid metal.

It is known to produce metallic powder in large vertical receivers known in general as reactors, at the top of which is introduced a jet of liquid metal from a melting furnace by means of a pouring ladle. At the top inlet to the reactor this liquid jet is subjected to vigorous atomization by jets of gas, preferably chemically neutral relative to the metal to be atomized, which make the jet of metal shatter into fine droplets which on cooling become powder which is collected at the bottom of the reactor.

One very great disadvantage of known reactors consists in their large volume and hence cumbersomeness. It is necessary to arrive at permanent thermal working conditions ensuring sufficient cooling of the metal, which is very hot at entry, and the heat can be extracted practically only by conductivity through the walls of the reactor, apart from the small amount of heat carried over by exhausting the neutral atomizing gas. Hence the necessity for a large lateral surface of the known reactors.

Another disadvantage of known reactors consists in a relatively large gas consumption due to the necessity of solidifying and cooling the liquid metal sufficiently.

The aim of the present invention is to enable an appreciable reduction in the lateral surface of the reactors and hence in their size to be made, while ensuring suitable cooling under permanent thermal working conditions, by acceleration of the heat transfer between the metallic material to be cooled and the walls of the receiver.

According to the present invention there is provided apparatus for manufacturing metallic power by gaseous atomization of a jet of liquid metal, comprising a vertical cylindro-conical receiver for receiving liquid metal through its top and comprising at its top part an annular arrangement of gas injectors for atomization of the liquid metal and an outlet for dust-laden gas, at its bottom part a hopper for metallic powder, and means for introducing gas into the bottom half of its cylindrical portion comprising at least one jet arranged tangentially to a theoretical cylinder centred on the axis of said receiver and passing through the outlet orifice of said jet.

If a plurality of jets are provided they are all arranged tangentially to a common theoretical cylinder centred upon the axis of the receiver and all opening in the same direction with respect to the axis of said theoretical cylinder.

The gas introduced into the bottom half of the cylindrical portion of the receiver can exhibit geometrical characteristics such that it causes vortices in the mixture of gas and metallic powder contained in the receiver, these vortices increasing the frequency of impact of the grains of metal against the wall of the receiver and thus quickening the thermal exchange between the gas and the wall. In the origin of these vortices it is the tangential introduction of gas which causes optimum turbulence.

The tangential jets may advantageously be tilted upwardly to make an angle lying 0° and 60°, preferably about 30°, with the horizontal.

Alternatively, the tangential jets may with advantage be tilted downwardly to make an angle between 0° and 60°, preferably about 30°, with the horizontal, as far as the geometry of the receiver enables reflection of the gas streams close to the tangential injectors.

The gas introduced by the tangential jet or jets into the bottom half of the cylindrical portion of the receiver to cause the vortices may be tapped off from the supply to the atomization injectors, or it may be tapped off from the gases leaving the receiver through the outlet at the top of the receiver, after extraction of their dust. This latter arrangement has a particular advantage of a relatively low gas consumption as compared with that of known reactors. In known reactors the flow of gas to the atomization ring is high, not in order to ensure atomization but to be able to ensure sufficient cooling of the metallic powder, whereas the flow of gas necessary only for atomization of the jet of liquid metal is much less. The flow of gas strictly necessary for atomization may usefully be introduced by means of the device described in French Patent No. 73-43159.

Thus in a conventional reactor capable of atomizing 30kg of metal per minute, that is to say, about 650g per kg of metal atomized for a mean grain size of 250 microns, the consumption of argon in the atomization ring is of the order of 18 to 20kg of gas per minute whilst in the reactor as described above the total argon flow is only 200 to 300 grammes per kg of metal atomized.

Preferably the gas flows are adjusted so that the pressure obtaining inside the receiver is constantly higher than the ambient pressure at every point on the circuit and lower than the ferrostatic pressure in the pouring ladle by which the receiver is supplied with molten metal, preferably between 0 and 150 millibars.

Under transient working conditions when the temperature inside the receiver is abnormally high a liquefied gas may be introduced for a short time into the bottom half of the receiver so that it evaporates inside the receiver as soon as it is introduced.

As is to be understood, one of the main advantages of the above described device is to enable vortices of the gas-powder mixture to be caused, so increasing the frequency of impact of the grains of metallic powder against the wall of the receiver, which brings about acceleration of the heat transfer between the gas-powder mixture and the wall.

Another advantage of the use of the invention is that the size of the reactor can thereby be significantly reduced, for example, by a half in dimension, the volume to be filled with gas thus becoming divided by approximately 8.

Thus a reactor capable of producing 30kg of powder per minute will have, if it is conventional, a height of about 10 meters and a diameter of 2 meters whilst one built using the invention may have a height of 4.500 m and a diameter of 1.100 m.

The invention will be better understood from the following description of two embodiments thereof, given by way of example only, with reference to the accompanying drawings, in which.

Figure 1:
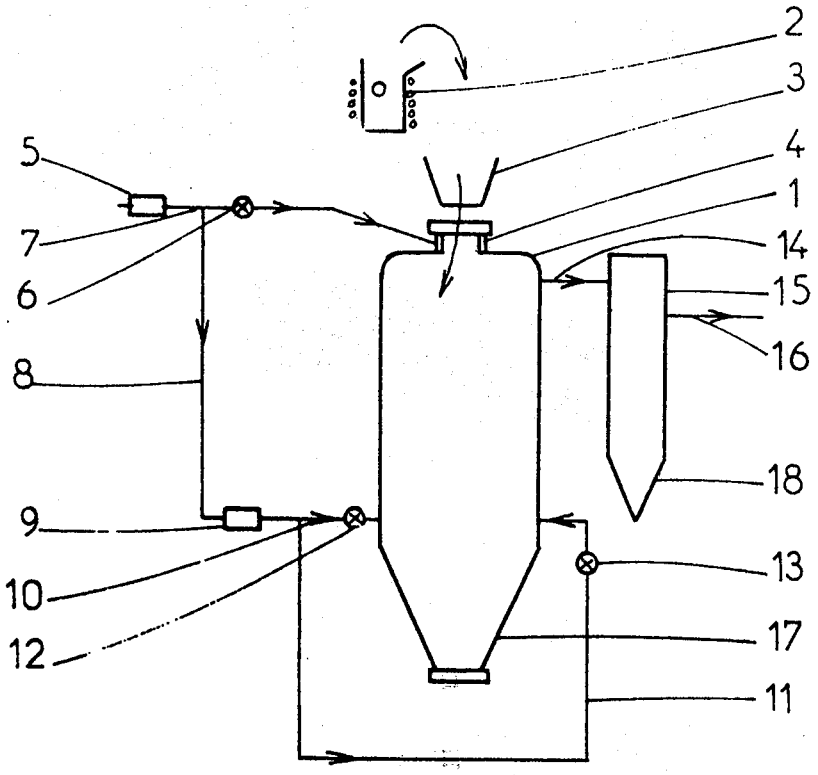
FIG. 1 is a vertical diagram of a first embodiment of apparatus according to the invention.

The embodiment shown in FIG. 1 comprises a vertical cylindro-conical reactor 1 which is supplied through the top with liquid metal from a high-frequency furnace 2 pouring liquid sttel into an intermediate ladle 3.

The top part of the reactor 1 comprises an atomization ring 4 comprising six injectors (not shown) for supplying argon gas at a pressure of 12 bars obliquely downwardly towards the axis of the reactor to make the vertical jet of liquid steel coming from the ladle 3 shatter into multiple droplets.

The pressure of the argon is reduced to 12 bars by a pressure-reduction valve 5 and its introduction is controlled by means of a valve 6. The pressure-reducer 5 and valve 6 are located in the main supply pipe 7.

Figure 4:
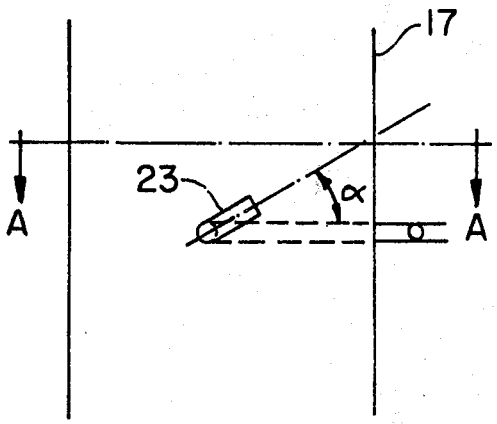
FIG. 4 is a vertical section through the reactor on the line B—B of FIG. 3 to show the tilt of the jets.
Figure 3:
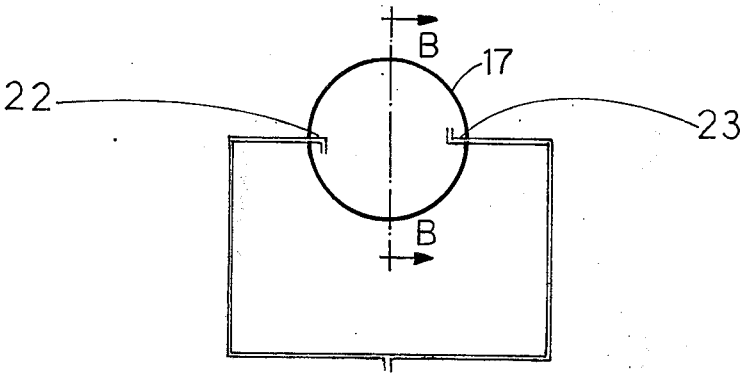
FIG. 3 is a horizontal section through the reactor of FIG. 1 or FIG. 2 along the horizontal plane A–A' through the pipes for feeding the tangential jets.

From this pipe 7 is taken a tapping 8 which goes first of all to feed a pressure-reducer 9 supplying argon at 1 to 2 bars to two pipes 10 and 11, provided with valves 12 and 13, which open into the bottom half of the reactor 1 and cause vortices as described above. These two pipes feed two tangetial jets or injectors 22 and 23 (FIG. 3) which are inclined upwardly or downwardly (FIG. 4) at an angle $\alpha$ of from 0° to 60° and here shown at about 30° 30° to the horizontal.

At the top part of the reactor argon laden with dust escapes through pipe 14 and passes into a dust-extractor 15 before escaping through pipe 16.

The powder thus manufactured is collected mainly in a hopper 17 arranged at the bottom of the reactor 1 and secondarily at the bottom of the dust-extractor 15 through hopper 18.

Figure 2:
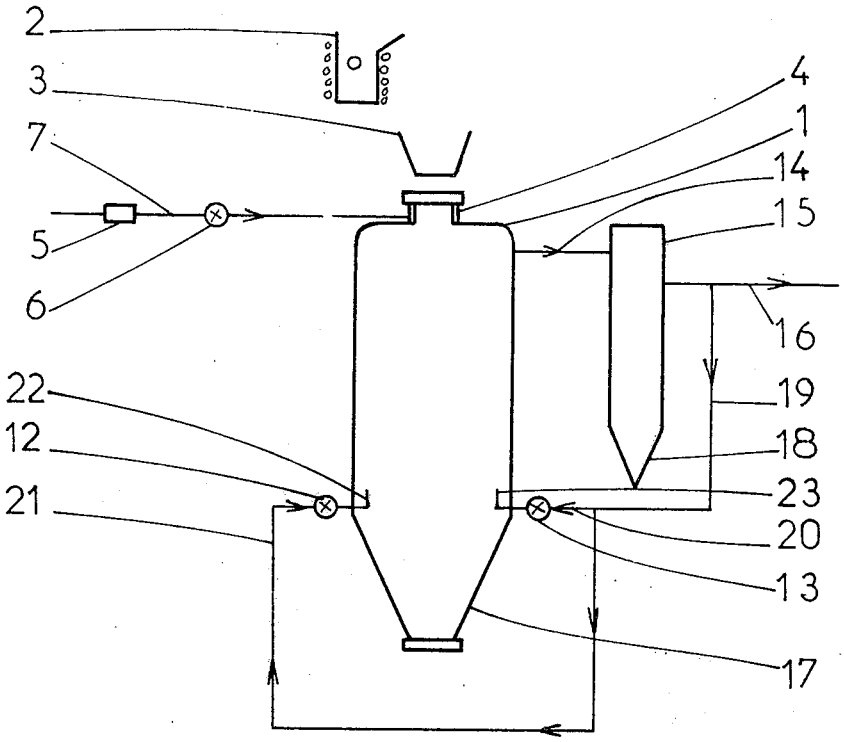
FIG. 2 is a vertical diagram of a second embodiment of apparatus in accordance with the invention.

A second embodiment shown in FIG. 2 differs from the foregoing only in the system of feeding of the secondary gas creating the vortices.

In the embodiment of FIG. 2 the secondary gas is tapped off from the exhaust pipe 16 after dust-extraction, at low pressure, and fed through channel 19 into two channels 20 and 21 regulated by valves 12 and 13. The dust-extraction fan is the driving means for circulating the gases in this embodiment.

By use of the above described apparatus metallic powders can easily be obtained, the grain size of which is completely contained within the range from 10 to 1500 microns with an average which may be of the order of 150 microns, for example.

We claim:

1. Apparatus for manufacturing metallic powder by gaseous atomization of a jet of liquid metal, comprising a vertical cylindro-conical receiver for receiving liquid metal through its top and comprising at its top part an annular arrangement of gas injectors for atomization of the liquid metal and an outlet for dust-laden gas, at its bottom part a hopper for metallic powder, and means for introducing gas into the bottom half of its cylindrical portion comprising a plurality of jets arranged tangentially to a theoretical cylinder centered on the axis of said receiver and opening in the same direction with respect to said axis and tilted from 0° to 60° with respect to the horizontal to cause vortices of inert gas and metallic powder and said theoretical cylinder passing through the outlet orifices of said jets.

2. Apparatus as claimed in claim 1, wherein said gas introduction means are connected to the feed to said injectors.

3. Apparatus as claimed in claim 1, wherein said gas introduction means are connected to the outlet of dust-extracting means connected to said gas outlet.

* * * * *